US008007661B1

(12) United States Patent
Schultz et al.

(10) Patent No.: US 8,007,661 B1
(45) Date of Patent: Aug. 30, 2011

(54) MODIFIED ABSORPTION RECOVERY PROCESSING OF FCC-PRODUCED LIGHT OLEFINS

(75) Inventors: Michael A. Schultz, Chicago, IL (US); David A. Wegerer, Lisle, IL (US); Gavin P. Towler, Inverness, IL (US)

(73) Assignees: UOP LLC, Des Plaines, IL (US); SNI S.p.A., Rome (IT)

( * ) Notice: Subject to any disclaimer, the term of this patent is extended or adjusted under 35 U.S.C. 154(b) by 897 days.

(21) Appl. No.: 11/643,884

(22) Filed: Dec. 21, 2006

(51) Int. Cl.
*C10G 11/18* (2006.01)

(52) U.S. Cl. ..... 208/101; 208/81; 208/83; 208/84; 208/102; 208/104; 208/113

(58) Field of Classification Search ..... 208/46, 208/81, 83, 84, 95, 100–106, 113–124, 308
See application file for complete search history.

(56) References Cited

U.S. PATENT DOCUMENTS

| | | | | |
|---|---|---|---|---|
| 3,702,886 | A | 11/1972 | Argauer et al. | |
| 4,072,604 | A * | 2/1978 | Ward | 208/101 |
| 4,894,141 | A | 1/1990 | Busch et al. | |
| 5,360,533 | A | 11/1994 | Tagamolila et al. | |
| 5,584,985 | A | 12/1996 | Lomas | |
| 5,858,206 | A | 1/1999 | Castillo | |
| 6,538,169 | B1 * | 3/2003 | Pittman et al. | 208/114 |
| 6,726,835 | B2 * | 4/2004 | Towler et al. | 208/211 |
| 6,843,906 | B1 | 1/2005 | Eng | |

FOREIGN PATENT DOCUMENTS

| | | |
|---|---|---|
| EP | 1 637 577 A2 | 3/2006 |

OTHER PUBLICATIONS

U.S. Appl. No. 11/540,793, filed Sep. 28, 2006.
U.S. Appl. No. 11/540,110, filed Sep. 28, 2006.
U.S. Appl. No. 11/541,218, filed Sep. 28, 2006.
U.S. Appl. No. 11/541,310, filed Sep. 28, 2006.
U.S. Appl. No. 11/540,088, filed Sep. 28, 2006.
U.S. Appl. No. 11/541,200, filed Sep. 28, 2006.

* cited by examiner

*Primary Examiner* — Randy Boyer
(74) *Attorney, Agent, or Firm* — James C Paschall

(57) ABSTRACT

Processing schemes and arrangements are provided arrangements are provided for the processing a heavy hydrocarbon feedstock via hydrocarbon cracking processing with selected hydrocarbon fractions being obtained via absorption-based product recovery while minimizing or avoiding loss of light olefins via system purging.

16 Claims, 1 Drawing Sheet

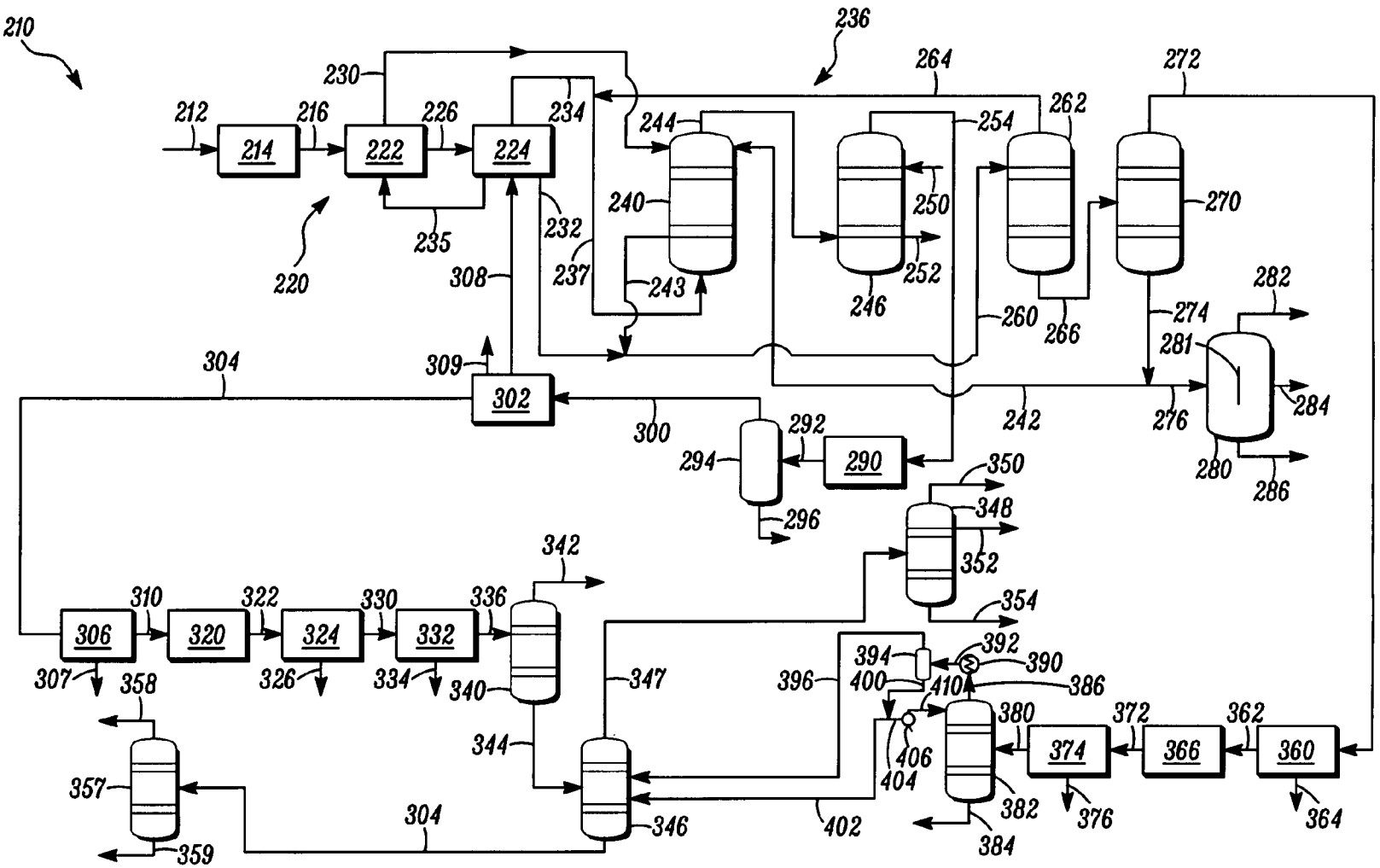
210
212
214
216
220
222
224
226
230
232
234
235
236
237
240
243
244
246
250
252
254
260
262
264
266
270
272
274
276
280
281
282
284
286
290
292
294
296
300
302
304
306
307
308
309
310
320
322
324
326
330
332
334
336
340
342
344
346
347
348
350
352
354
357
358
359
360
362
364
366
372
374
376
380
382
384
386
390
392
394
396
400
402
404
406
410

MODIFIED ABSORPTION RECOVERY PROCESSING OF FCC-PRODUCED LIGHT OLEFINS

BACKGROUND OF THE INVENTION

This invention relates generally to hydrocarbon processing and, more particularly, to the processing of hydrocarbon-containing materials having a high light olefin content, such as produced or formed in or by the cracking of a heavy hydrocarbon feedstock.

Light olefins serve as feed materials for the production of numerous chemicals. Light olefins have traditionally been produced through the processes of steam or catalytic cracking of hydrocarbons such as derived from petroleum sources. Fluidized catalytic cracking (FCC) of heavy hydrocarbon streams is commonly carried out by contacting a starting material whether it be vacuum gas oil, reduced crude, or another source of relatively high boiling hydrocarbons with a catalyst such as composed of finely divided or particulate solid material. The catalyst is transported in a fluid-like manner by transmitting a gas or vapor through the catalyst at sufficient velocity to produce a desired regime of fluid transport. Contact of the oil with the fluidized material catalyzes the cracking reaction.

The cracking reaction typically deposits coke on the catalyst. Catalyst exiting the reaction zone is commonly referred to as being "spent", i.e., partially deactivated by the deposition of coke upon the catalyst. Coke is comprised of hydrogen and carbon and can include, in trace quantities, other materials such as sulfur and metals such that may enter the process with the starting material. The presence of coke interferes with the catalytic activity of the spent catalyst. It is believed that the coke blocks acid sites on the catalyst surface where the cracking reactions take place. Spent catalyst is traditionally transferred to a stripper that removes adsorbed hydrocarbons and gases from catalyst and then to a regenerator for the purpose of removing the coke by oxidation with an oxygen-containing gas. An inventory of catalyst having a reduced coke content, relative to the spent catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated between the reaction zone and the regeneration zone. The fluidized catalyst, as well as providing a catalytic function, serves as a vehicle for the transfer of heat from zone to zone. FCC processing is more fully described in U.S. Pat. No. 5,360,533 to Tagamolila et al., U.S. Pat. No. 5,584,985 to Lomas, U.S. Pat. No. 5,858,206 to Castillo and U.S. Pat. No. 6,843,906 B1 to Eng. Specific details of the various contact zones, regeneration zones, and stripping zones along with arrangements for conveying the catalyst between the various zones are well known to those skilled in the art.

The FCC reactor serves to crack gas oil or heavier feeds into a broad range of products. Cracked vapors from an FCC unit enter a separation zone, typically in the form of a main column, that provides a gas stream, a gasoline cut, light cycle oil (LCO) and clarified oil (CO) which includes heavy cycle oil (HCO) components. The gas stream may include dry gas, i.e., hydrogen and $C_1$ and $C_2$ hydrocarbons, and liquefied petroleum gas ("LPG"), i.e., $C_3$ and $C_4$ hydrocarbons, also sometimes commonly referred to as wet gas.

In view of an increasing need and demand for light olefins such as ethylene and propylene for various petrochemical uses such as for the production of polyethylene, polypropylene and the like as well as the desire to produce relatively less of heavier olefins such as butylenes and pentenes which are generally less desirable as gasoline blending components due to environmental considerations, it may be desired to practice the cracking reaction processing of heavy hydrocarbon feedstock to increase the relative amount of light olefins in the resulting product slate.

Research efforts have led to the development of an FCC process that produces or results in greater relative yields of light olefins, i.e., ethylene and propylene. Such processing is more fully described in U.S. Pat. No. 6,538,169 B1 to Pittman et al. As disclosed therein, a hydrocarbon feed stream can desirably be contacted with a blended catalyst comprising regenerated catalyst and coked catalyst. The catalyst has a composition including a first component and a second component. The second component comprises a zeolite with no greater than medium pore size wherein the zeolite comprises at least 1 wt. % of the catalyst composition. The contacting occurs in a riser to crack hydrocarbons in the feed stream and obtain a cracked stream containing hydrocarbon products including light olefins and coked catalyst. The cracked stream is passed out of an end of the riser such that the hydrocarbon feed stream is in contact with the blended catalyst in the riser for less than or equal to 2 seconds on average.

While traditional absorption-based FCC gas concentration units and processing are generally effective for recovering propylene using a primary absorber followed by a secondary or sponge absorber, the recovery of ethylene has proven more troublesome. For example, it is common for such traditional absorption-based FCC gas concentration units and processing to utilize a purge stream to remove undesired ethane from the system. Unfortunately, such purging of ethane is typically accompanied by the loss of valued ethylene material.

In view of the increasing need and demand for light olefins such as ethylene and propylene, there is a need and a demand for improved processing and arrangements for the separation and recovery of light olefins from such FCC process effluent.

SUMMARY OF THE INVENTION

A general object of the invention is to provide an improved process and system for catalytically cracking a heavy hydrocarbon feedstock and obtaining selected hydrocarbon fractions.

The general object of the invention can be attained, at least in part, through a specified process such as involves contacting a heavy hydrocarbon feedstock with a hydrocarbon cracking catalyst in a fluidized reactor zone to produce a hydrocarbon effluent comprising a range of cracked hydrocarbon products including light olefins. In accordance with one preferred embodiment, the hydrocarbon cracking catalyst is desirably of a composition that includes a first component comprising a large pore molecular sieve and a second component comprising a zeolite with no greater than medium pore size, with the zeolite with no greater than medium pore size comprising at least 1.0 wt. % of the catalyst composition. The hydrocarbon effluent is separated in a separation section to form at least one separator liquid stream and a separator vapor stream. The at least one separator liquid stream includes $C_3$+ hydrocarbons. The separator vapor stream includes $C_3$− hydrocarbons. The separator vapor stream is contacted with a first absorption solvent in an absorption zone to remove $C_3$+ hydrocarbons therefrom and form a process stream that includes $C_2$− hydrocarbon materials. $C_1$− materials are desirably stripped from the at least one separator liquid stream in a stripper section to form a $C_2$+ hydrocarbon process stream substantially free of $C_1$− materials. $C_5$+ hydrocarbon materials are separated from the $C_2$+ hydrocarbon process stream to form a first product process stream that includes $C_5$+ hydrocarbon materials and a second product process stream that includes $C_2$, $C_3$ and $C_4$ hydrocarbons. At least a first portion of the first product stream is desirably introduced into the absorption zone as at least a portion of the first absorption solvent.

The prior art generally fails to provide processing schemes and arrangements for obtaining light olefins via the catalytic cracking of a heavy hydrocarbon feedstock in an as effective and efficient a manner as may be desired. More particularly, the prior art generally fails to provide such processing schemes and arrangements that advantageously utilize absorption-based product recovery to produce or otherwise obtain process streams containing specifically desired ranges of hydrocarbons.

A process for catalytically cracking a heavy hydrocarbon feedstock and obtaining selected hydrocarbon fractions, in accordance with another embodiment, involves contacting a heavy hydrocarbon feedstock with a blended cracking catalyst that includes regenerated catalyst and coked catalyst in a fluidized reactor zone at hydrocarbon cracking reaction conditions to produce a hydrocarbon effluent stream comprising a range of hydrocarbon products including light olefins. The catalyst desirably is of a catalyst composition that includes a first component comprising a large pore molecular sieve and a second component comprising a zeolite with no greater than medium pore size, said zeolite with no greater than medium pore size comprising at least 1.0 wt. % of the catalyst composition.

The process further involves separating the hydrocarbon effluent in a separation section to form at least one separator high pressure liquid stream and a separator high pressure vapor stream. The at least one separator high pressure liquid stream comprises $C_3$+ hydrocarbons. The separator high pressure vapor stream comprises $C_3$− hydrocarbons. The separator high pressure vapor stream is contacted with a first absorption solvent in a primary absorber to form a first primary absorber process stream that includes primarily $C_2$− hydrocarbons and residual amounts of $C_3$+ hydrocarbons. The first primary absorber process stream is contacted with a second absorption solvent to form a process stream including $C_2$− hydrocarbon materials and a process stream including residual $C_3$+ hydrocarbons and the second absorption solvent. $C_1$− materials are stripped from the separator high pressure liquid stream to form a $C_2$+ hydrocarbon process stream substantially free of $C_1$− materials. $C_5$+ hydrocarbon materials are separated from the $C_2$+ hydrocarbon process stream to form a first product process stream including $C_5$+ hydrocarbon materials and a second product process stream including $C_2$, $C_3$ and $C_4$ hydrocarbons. The process further involves introducing at least a first portion of the first product stream to the primary absorber as a majority of the first absorption solvent.

A system for catalytically cracking a heavy hydrocarbon feedstock and obtaining selected hydrocarbon fractions is also provided. In accordance with one preferred embodiment, such as system includes a fluidized reactor zone wherein the heavy hydrocarbon feedstock contacts a hydrocarbon cracking catalyst at hydrocarbon cracking reaction conditions to produce a hydrocarbon effluent comprising a range of cracked hydrocarbon products including light olefins.

The system also includes a separation section for separating the cracked effluent stream to form at least one separator liquid stream and a separator vapor stream. The at least one separator liquid stream comprises $C_3$+ hydrocarbons. The separator vapor stream comprises $C_3$− hydrocarbons.

The system further includes an absorption zone to absorb $C_3$+ hydrocarbons from the separator high pressure vapor stream in a first absorption solvent and to form an absorption zone effluent stream that includes $C_2$− hydrocarbons, including ethylene. A stripper is provided for stripping $C_1$− materials from the separator liquid stream to form a $C_2$+ process stream substantially free of $C_1$− materials. A debutanizer is provided for separating $C_5$+ hydrocarbon materials from the $C_2$+ hydrocarbon process stream to form a first process stream comprising $C_5$+ hydrocarbon materials and a second process stream comprising $C_2$, $C_3$ and $C_4$ hydrocarbons. The system also includes a process line for introducing at least a first portion of the first product stream to the absorption zone as a majority of the first absorption solvent.

As used herein, references to "light olefins" are to be understood to generally refer to $C_2$ and $C_3$ olefins, i.e., ethylene and propylene, alone or in combination.

References to light olefin materials or appropriate process streams as being "substantially free of carbon dioxide" are to be understood to generally refer to such light olefin materials or process streams as desirably generally containing less than about 100 ppm of carbon dioxide, preferably containing less than about 10 ppm of carbon dioxide and, more preferably, desirably containing less than about 1 ppm of carbon dioxide.

References to "$C_x$ hydrocarbon" are to be understood to refer to hydrocarbon molecules having the number of carbon atoms represented by the subscript "x". Similarly, the term "$C_x$-containing stream" refers to a stream that contains $C_x$ hydrocarbon. The term "$C_x$+ hydrocarbons" refers to hydrocarbon molecules having the number of carbon atoms represented by the subscript "x" or greater. For example, "$C_4$+ hydrocarbons" include $C_4$, $C_5$ and higher carbon number hydrocarbons. The term "$C_x$− hydrocarbons" refers to hydrocarbon molecules having the number of carbon atoms represented by the subscript "x" or fewer. For example, "$C_4$− hydrocarbons" include $C_4$, $C_3$ and lower carbon number hydrocarbons.

Other objects and advantages will be apparent to those skilled in the art from the following detailed description taken in conjunction with the appended claims and drawing.

BRIEF DESCRIPTION OF THE DRAWING

The FIGURE is a simplified schematic diagram of a system for catalytic cracking a heavy hydrocarbon feedstock and obtaining selected hydrocarbon fractions, including light olefins via an absorption-based product recovery, in accordance with one preferred embodiment.

Those skilled in the art and guided by the teachings herein provided will recognize and appreciate that the illustrated system or process flow diagram have been simplified by the elimination of various usual or customary pieces of process equipment including some heat exchangers, process control systems, pumps, fractionation systems, and the like. It may also be discerned that the process flow depicted in the FIGURE may be modified in many aspects without departing from the basic overall concept of the invention.

DETAILED DESCRIPTION

Processing schemes and arrangements are provided for effectively and efficiently processing a heavy hydrocarbon feedstock via hydrocarbon cracking processing with selected hydrocarbon fractions being obtained via absorption-based product recovery.

The FIGURE schematically illustrates a system, generally designated by the reference numeral 210, for catalytic cracking a heavy hydrocarbon feedstock and obtaining light olefins via absorption-based product recovery, in accordance with one embodiment of the invention. In the system 210, a suitable heavy hydrocarbon feedstock stream is introduced via a line 212 into a fluidized reactor zone 214 wherein the heavy hydrocarbon feedstock contacts with a hydrocarbon cracking catalyst zone to produce a hydrocarbon effluent comprising a range of hydrocarbon products, including light olefins.

Suitable fluidized catalytic cracking reactor zones for use in the practice of such an embodiment may, as is described in above-identified U.S. Pat. No. 6,538,169 B1 to Pittman et al., include a separator vessel, a regenerator, a blending vessel, and a vertical riser that provides a pneumatic conveyance zone in which conversion takes place. The arrangement circulates catalyst and contacts feed in a specifically described manner.

More specifically and as described therein, the catalyst typically comprises two components that may or may not be on the same matrix. The two components are circulated throughout the entire system. The first component may include any of the well-known catalysts that are used in the art of fluidized catalytic cracking, such as an active amorphous clay-type catalyst and/or a high activity, crystalline molecular sieve. Molecular sieve catalysts are preferred over amorphous catalysts because of their much-improved selectivity to desired products. Zeolites are the most commonly used molecular sieves in FCC processes. Preferably, the first catalyst component comprises a large pore zeolite, such as a Y-type zeolite, an active alumina material, a binder material, comprising either silica or alumina and an inert filler such as kaolin.

The zeolitic molecular sieves appropriate for the first catalyst component should have a large average pore size. Typically, molecular sieves with a large pore size have pores with openings of greater than 0.7 nm in effective diameter defined by greater than 10 and typically 12 membered rings. Pore Size Indices of large pores are above about 31. Suitable large pore zeolite components include synthetic zeolites such as X-type and Y-type zeolites, mordenite and faujasite. It has been found that Y zeolites with low rare earth content are preferred in the first catalyst component. Low rare earth content denotes less than or equal to about 1.0 wt. % rare earth oxide on the zeolite portion of the catalyst. Octacat™ catalyst made by W. R. Grace & Co. is a suitable low rare earth Y-zeolite catalyst.

The second catalyst component comprises a catalyst containing, medium or smaller pore zeolite catalyst exemplified by ZSM-5, ZSM-11, ZSM-12, ZSM-23, ZSM-35, ZSM-38, ZSM-48, and other similar materials. U.S. Pat. No. 3,702,886 describes ZSM-5. Other suitable medium or smaller pore zeolites include ferrierite, erionite, and ST-5, developed by Petroleos de Venezuela, S.A. The second catalyst component preferably disperses the medium or smaller pore zeolite on a matrix comprising a binder material such as silica or alumina and an inert filer material such as kaolin. The second component may also comprise some other active material such as Beta zeolite. These catalyst compositions have a crystalline zeolite content of 10-25 wt. % or more and a matrix material content of 75-90 wt. %. Catalysts containing 25 wt. % crystalline zeolite material are preferred. Catalysts with greater crystalline zeolite content may be used, provided they have satisfactory attrition resistance. Medium and smaller pore zeolites are characterized by having an effective pore opening diameter of less than or equal to 0.7 nm, rings of 10 or fewer members and a Pore Size Index of less than 31.

The total catalyst composition should contain 1-10 wt. % of a medium to small pore zeolite with greater than or equal to 1.75 wt. % being preferred. When the second catalyst component contains 25 wt. % crystalline zeolite, the composition contains 4-40 wt. % of the second catalyst component with a preferred content of greater than or equal to 7 wt. %. ZSM-5 and ST-5 type zeolites are particularly preferred since their high coke resistivity will tend to preserve active cracking sites as the catalyst composition makes multiple passes through the riser, thereby maintaining overall activity. The first catalyst component will comprise the balance of the catalyst composition. The relative proportions of the first and second components in the catalyst composition will not substantially vary throughout the FCC unit.

The high concentration of the medium or smaller pore zeolite in the second component of the catalyst composition improves selectivity to light olefins by further cracking the lighter naphtha range molecules. But at the same time, the resulting smaller concentration of the first catalyst component still exhibits sufficient activity to maintain conversion of the heavier feed molecules to a reasonably high level.

The relatively heavier feeds suitable for processing in accordance herewith include conventional FCC feedstocks or higher boiling or residual feeds. A common conventional feedstock is vacuum gas oil which is typically a hydrocarbon material prepared by vacuum fractionation of atmospheric residue and which has a broad boiling range of from 315-622° C. (600-1150° F.) and, more typically, which has a narrower boiling point range of from 343-551° C. (650-1025° F.). Heavy or residual feeds, i.e., hydrocarbon fractions boiling above 499° C. (930° F.), are also suitable. The fluidized catalytic cracking processing the invention is typically best suited for feedstocks that are heavier than naphtha range hydrocarbons boiling above about 177° C. (350° F.).

The effluent or at least a selected portion thereof is passed from the fluidized reactor zone 214 through a line 216 into a hydrocarbon separation system 220, such as includes a main column section 222 and a staged compression section 224. The main column section 222 may desirably include a main column separator with an associated main column overhead high pressure receiver wherein the fluidized reactor zone effluent can be separated into desired fractions including a main column vapor stream, such as passed through a line 226, and a main column liquid stream, such as passed through a line 230.

To facilitate illustration and discussion, other fraction lines such as including a heavy gasoline stream, a light cycle oil ("LCO") stream, a heavy cycle oil ("HCO") stream and a clarified oil ("CO") stream, for example, may not here be shown nor hereinafter specifically described.

The main column vapor stream line 226 is introduced into the staged compression section 224, such as constituting a two-stage compression. The staged compression section 224 results in the formation of a high pressure separator liquid stream in a line 232 and a high pressure separator vapor stream in a line 234. While the pressure of such high pressure liquid and high pressure vapor can vary, in practice such streams are typically at a pressure in the range of about 1375 kPa gauge to about 2100 kPa gauge (about 200 psig to about 300 psig). The compression section 224 may also result in the formation of a stream of spill back materials largely composed of heavier hydrocarbon materials and such as can be returned to the main column section 222 via a line 235.

The high pressure separator liquid stream includes $C_3$+ hydrocarbons and is substantially free of carbon dioxide. The high pressure separator vapor stream includes $C_3$– hydrocarbons and typically includes a quantity of carbon dioxide.

The separator vapor stream line 234 is introduced into an absorption zone, generally designated by the reference numeral 236, via a line 237. The absorption zone 236 includes a primary absorber 240 wherein the separator vapor stream contacts with a debutanized gasoline material provided by the line 242 and the main column liquid stream provided by the line 230 to absorb $C_3$+ and separate $C_2$ and lower boiling fractions from the gas to the primary absorber 240. In general, the absorption zone 236 includes a primary absorber that suitably includes a plurality of stages with at least one and preferably two or more intercoolers interspaced therebetween to assist in achieving desired absorption. In practice, such a primary absorber typically includes about five absorber stages between each pair intercoolers. Thus, a primary absorber to achieve desired absorption in accordance with one preferred embodiment desirably includes at least about 15 ideal stages with at least 2 intercoolers appropriately spaced therebetween. In another preferred embodiment, a suitable preferred primary absorber to achieve desired absorption desirably includes at least about 20 ideal stages with at least 3 intercoolers appropriately spaced therebetween. In yet another preferred embodiment, a suitable preferred primary absorber to achieve desired absorption desirably includes at about 20 to about 25 ideal stages with 4 or more intercoolers appropriately spaced therebetween. While the broader practice of the invention is not necessarily so limited, in at least certain preferred embodiments, it has been found advantageous to employ propylene as a refrigerant in one or more of such primary absorber the intercoolers to assist in achieving the desired absorption.

The $C_3$+ hydrocarbons absorbed in or by the debutanized gasoline and main column liquid can be passed via a line 243 for further processing in accordance with the invention as later described herein.

The off gas from the primary absorber 240 passes via a line 244 to a secondary or sponge absorber 246. The secondary absorber 246 contacts the off gas with light cycle oil from a line 250. Light cycle oil absorbs most of the remaining $C_4$ and higher hydrocarbons and returns to the main fractionators via a line 252. A stream of $C_2$ and lighter materials is withdrawn as off gas from the secondary or sponge absorber 246 in a line 254 for further treatment as later described herein.

The separator liquid stream in the line 232 and contents from the line 243 are passed through a line 260 into a stripper 262 which removes most of the $C_1$ and lighter gases in a line 264. In practice, such a stripper can desirably be operated at a pressure in the range of about 2340 kPa gauge to about 2485 kPa gauge (about 340 psig to about 360 psig) with less than 0.005 mol % $C_1$ materials and, in accordance with certain preferred embodiments, less than about 0.001 mol % $C_1$ materials in the stripper bottoms. As will be appreciated by those skilled in the art and guided by the teachings herein provided, such a stripper is desirably operated at a sufficiently high pressure such that desired separation between $C_1$– materials and $C_2$+ hydrocarbons is realized. As will further be appreciated, by desirably maintaining such sufficiently high pressure through various of the downstream processing units such as described more fully below, such processing allows maintaining the absorbed ethylene in a liquid phase.

As shown, $C_1$– materials in the line 264 can desirably be combined with high pressure separator vapor from the line 234 to form the line 237 that is fed into the primary absorber 240. The stripper 262 supplies a liquid $C_2$+ stream via a line 266 to a debutanizer 270. A suitable such debutanizer, in accordance with one preferred embodiment, includes a condenser (not specifically shown) that desirably operates at a pressure in the range of about 2170 kPa gauge to about 2310 kPa gauge (about 315 psig to about 335 psig), with no more than about 5 mol % $C_5$ hydrocarbons in the overhead and no more than about 5 mol % $C_4$ hydrocarbons in the bottoms. More preferably, the relative amount of $C_5$ hydrocarbons in the overhead is less than about 1-3 mol % and the relative amount of $C_4$ hydrocarbons in the bottoms is less than about 1-3 mol %. Furthermore, the overhead condenser of such a debutanizer can desirably be cooled using condensing water or air.

A stream of $C_2$, $C_3$ and $C_4$ hydrocarbons from the debutanizer 270 is taken overhead by a line 272 for further treatment, such as later described herein. A line 274 withdraws a stream of debutanized gasoline from the debutanizer 270. In accordance with one preferred embodiment, the stream of debutanized gasoline returned to the primary absorber 240 via the line 242 serves as the majority of the first absorption solvent therein.

Another portion of the stream of debutanized gasoline is passed in a line 276 to a naphtha splitter 280.

In accordance with one preferred embodiment, the naphtha splitter 280 is desirably in the form of a dividing wall separation column, such as having a dividing wall 281 positioned therewithin. Such a dividing wall separation column naphtha splitter is desirably effective to separate the debutanized gasoline introduced therein into a light fraction stream comprising compounds containing five to six carbon atoms, an intermediate fraction stream comprising compounds containing seven to eight carbon atoms, and a heavy fraction stream comprising compounds containing more than eight carbon atoms. More specifically, such a dividing wall separation column may generally operate at a condenser pressure in the range of about 34 kPa gauge to about 104 kPa gauge (about 5 psig to about 15 psig) and, in accordance with one embodiment operated at a condenser pressure of about 55 kPa gauge to about 85 kPa gauge (about 8 psig to about 12 psig).

Such light, intermediate and heavy fraction streams, are appropriately passed via corresponding lines 282, 284, and 286, respectively, for further processing or product recovery, as may be desired.

Returning to the processing of the stream of $C_2$– hydrocarbons withdrawn from the secondary or sponge absorber 246 in the line 254, such stream materials can be passed through a further compression section 290 to form an effluent such as having a pressure in the range of about 3100 kPa gauge to about 3800 kPa gauge (about 450 psig to about 550 psig) and, in accordance with one embodiment, a pressure more preferably in a range of about 3275 kPa gauge to about 3620 kPa gauge (about 475 psig to about 525 psig). The compression section 290 effluent is passed via a line 292 into a compression or discharge drum 294. The discharge drum 294 forms a knockout stream generally composed of heavy components (e.g., $C_3$+ hydrocarbons that liquefy in the discharge drum 294) and such as withdrawn in a line 296. The discharge drum 294 also forms an overhead stream that primarily comprising $C_2$– hydrocarbons, with typically no more than trace amounts (e.g., less than 1 wt. %) of $C_3$+ hydrocarbons, withdrawn in a line 300.

The overhead stream in the line 300 is passed to an amine treatment section 302 such as may be desired to effect $CO_2$ removal therefrom. The utilization of amine treatment systems for carbon dioxide and/or hydrogen sulfide removal are well known in the art. Conventional such amine treatment systems typically employ an amine solvent such as methyl diethanol amine [MDEA] to absorb or otherwise separate $CO_2$ from hydrocarbon stream materials. A stripper or regenerator is typically subsequently used to strip the absorbed $CO_2$ from the amine solvent, permitting the reuse of the amine solvent.

While such amine treatment has proven generally effective for removal of carbon dioxide from various hydrocarbon-containing streams, the application of such amine treatment to ethylene-rich hydrocarbon and carbon dioxide-containing streams, such as being processed at this point of the subject system, may experience some undesired complications as some of the olefin material may be co-absorbed with the $CO_2$ in or by the amine solvent. Such co-absorption of olefin material undesirably reduces the amounts of light olefins available for recovery from such processing. Moreover, during such subsequent stripper processing of the amine solvent, the presence of such olefin materials can lead to polymerization. Such polymerization can lead to degradation of the amine solvent and require expensive off-site reclamation processing.

In view thereof, it may be desirable to utilize an amine treatment system such as includes or incorporates a pre-stripper interposed between the amine system absorber and the amine system stripper/regenerator. Such an interposed pre-stripper, can desirably serve to separate hydrocarbon materials, including light olefins such as ethylene, from the carbon dioxide and amine solvent prior to subsequent processing through the regenerator/stripper.

A stream containing $C_2$− hydrocarbons substantially free of carbon dioxide is passed through a line 304 to a drier section 306 with water withdrawn therefrom in a line 307. A stream containing stripped hydrocarbons and possibly minor amounts (e.g., typically less than 1 wt. %) of $CO_2$ is conveyed via a line 308 such as back to the compression section 224 such as for further processing such as consistent with the above description. A stream containing $CO_2$ is conveyed from the amine treatment section 302 via a line 309.

A stream containing dried $C_2$− hydrocarbons substantially free of carbon dioxide is passed via a line 310 to an acetylene conversion section or unit 320. As is known in the art, acetylene conversion sections or units are effective to convert acetylene to form ethylene. Thus, an additionally ethylene-enriched process stream is withdrawn in a line 322 from the acetylene conversion section or unit 320.

As the acetylene conversion may result in additional formation of water, the process stream in the line 322 can, if desired, be introduced into an optional drier unit 324 such as with water being withdrawn therefrom in a line 326 and with the resulting dried process stream passed via a line 330 to an optional further treatment section 332 such as in the form of a $CO_2$, carbonyl sulfide ("COS"), Arsine and/or Phosphine treater as is known in the art to effect removal of $CO_2$, COS, Arsine and/or Phosphine, withdrawn in a line 334, and a treated stream such as withdrawn in a line 336.

The treated stream in the line 336 may desirably be introduced into a demethanizer 340. A suitable such demethanizer, in accordance with one preferred embodiment, includes a condenser (not specifically shown) that desirably operates at a temperature of no greater than about −90° C. (−130° F.), more preferably operates at a temperature in the range of about −90° C. to about −102° C., preferably about −96° C. (−130° F. to about −150° F., preferably at about −140° F.). In addition, a preferred demethanizer for use in the practice of the invention desirably operates with a methane to ethylene molar ratio in the bottoms of no greater than about 0.0005 and, more preferably at a methane to ethylene molar ratio in the bottoms of no greater than about 0.0003 to about 0.0002.

A stream of methane and hydrogen gas from the demethanizer 340 is taken overhead via a line 342 such as for use as a fuel or, if desired for further processing or treatment such as to a pressure swing absorption unit (not shown) for $H_2$ recovery.

A line 344 withdraws a stream of demethanized material from the demethanizer 340. The demethanized material line is passed via the 344 to a deethanizer 346. A suitable such deethanizer, in accordance with one preferred embodiment, generally desirably operates at a pressure in the range of about 1550 kPa gauge to about 1670 kPa gauge (about 225 psig to about 245 psig), with a recovery of at least about 98 mol % of the $C_2$ hydrocarbons in the overhead, more preferably with the recovery of at least in the range of 99 mol % of the $C_2$ hydrocarbons in the overhead and with a recovery of at least 98 mol % of the $C_3$ hydrocarbons in the bottoms product, more preferably with the recovery of at least about 99.5 mol % of the $C_3$ hydrocarbons in the bottoms product.

From the deethanizer 346, a stream of $C_2$− hydrocarbons is taken overhead via a line 347. The line 347 and the stream of materials therein contained are introduced into an ethylene/ethane splitter 348. A suitable such ethane/ethylene splitter, in accordance with one preferred embodiment, includes a condenser (not specifically shown) that desirably operates at a pressure in the range of about 1930 kPa gauge to about 2105 kPa gauge (about 280 psig to about 305 psig), and desirably operates such that there is no more than about 1 vol. % ethane in the ethylene product stream, preferably less than about 0.1 vol. % ethane in the ethylene product stream and, more preferably, less than about 0.05 vol. % ethane in the ethylene product stream.

The ethylene/ethane splitter 348 forms a vapor stream of remaining light ends, a partial condensate stream of ethylene and a bottoms stream of ethane which are passed through lines 350, 352 and 354, respectively, such as either for product recovery or further desired processing, as is known in the art.

The deethanizer 346 also produces or forms a stream of $C_3$+ hydrocarbons such as withdrawn therefrom via a line 356. The line 356 introduces the materials passing therein into a propylene/propane splitter 357. A suitable such propane/propylene splitter, in accordance with one preferred embodiment, desirably operates such that at least 98 wt. % and, preferably, at least about 99 wt. % of the propylene recovery is in the overhead stream and the propylene in the overhead stream is at least about 99.5% pure.

The propylene/propane splitter 357 forms a stream of propylene and a stream of propane which are passed through lines 358 and 359, respectively, such as either for product recovery or further desired processing, as is known in the art.

Returning to the processing of the stream containing $C_2$, $C_3$ and $C_4$ hydrocarbons taken overhead from the debutanizer 270 via the line 272, as such a process stream may contain some significant relative amounts of hydrogen sulfide, the line 272 can desirably be passed to a sulfide removal treatment unit 360 such as known in the art, such as in the form of an amine treatment section, such as to form a treated stream passed via a line 362. The hydrogen sulfide content of the treated stream is desirably reduced down to about 20 ppm, with hydrogen sulfide being removed via a line 364.

This stream of materials may contain or include significant relative amounts or quantities of diolefinic hydrocarbons. Thus, as shown and in accordance with one preferred embodiment, the system 210 may desirably include or contain a selective hydrogenation process unit 366 to convert such diolefinic materials to corresponding olefin materials.

A treated stream with an appropriately reduced relative amount or quantity of diolefinic materials is passed via a line 372 to a mercaptan treatment section 374, such as to effect mercaptan removal from the stream materials such as via caustic wash as is known in the art. Mercaptans are shown as removed via a line 376.

The resulting stream is passed via a line 380 either directly to a $C_3/C_4$ splitter 382 or, alternatively if desired, first through a drier section (not shown) and then to on to the $C_3/C_4$ splitter. A suitable such $C_3/C_4$ splitter, in accordance with one preferred embodiment and as described in greater detail below, includes a partial condenser that desirably operates at a pressure in the range of about 2000 kPa gauge to about 2140 kPa gauge (about 290 psig to about 310 psig), preferably at a pressure of about 2070 kPa (about 300 psig) and desirably operates such that there is no more than about 5 mol. % $C_4$s in the overhead product stream, preferably less than about 1 mol. % $C_4$s in the overhead product stream and no more than about 5 mol. % $C_3$s in the bottoms stream, preferably less than about 1 mol. % $C_3$s in the bottoms stream. Furthermore, such partial condenser can desirably be cooled using condensing water or air.

The $C_3/C_4$ splitter 382 forms a stream of mixed $C_4$+ hydrocarbons which is passed through a line 384 such as either for product recovery or further desired processing, as is known in the art.

The $C_3/C_4$ splitter 382 also forms a stream composed primarily of $C_2$ and $C_3$ hydrocarbons which is passed through an overhead line 386 to a partial condenser 390 with a stream of resulting material passed via a line 392 to an overhead receiver 394. In the overhead receiver 394, $C_2/C_3$ separation occurs producing an ethylene-rich $C_2$ hydrocarbon vapor stream being passed via a line 396 to the deethanizer 346 and a propylene-rich $C_3$ hydrocarbon liquid stream being passed via a line 400 and split to form a net liquid product stream passed via a line 402 to the deethanizer 346 and a liquid return stream passed via a line 404 to a reflux pump 406 and then via a reflux line 410 to the $C_3/C_4$ splitter 382.

As shown in the FIGURE, both the ethylene-rich $C_2$ hydrocarbon vapor stream being passed via the line 396 and the propylene-rich $C_3$ hydrocarbon liquid stream passed via the line 402 are introduced into the deethanizer 346. Where, as shown, the deethanizer 346 is in the form of a tray-containing deethanizer column, the ethylene-rich $C_2$ hydrocarbon vapor stream is desirably introduced to a tray near the top of the column, while the propylene-rich $C_3$ hydrocarbon liquid stream is desirably introduced to a tray near the bottom of the column.

Thus processing schemes and arrangements are desirably provided for obtaining light olefins via the catalytic cracking of a heavy hydrocarbon feedstock. More particularly, processing schemes and arrangements are provided that advantageously utilize absorption-based product recovery to produce or otherwise form process streams containing specifically desired ranges of hydrocarbons and which processing schemes and arrangements desirably minimize or avoid loss of valuable ethylene via system purge. As a result, such processing offers the opportunity for greater or increased ethylene recovery.

Alternatively, the level or extent of ethylene recovery can be maintained while employing respectively reduced sized processing units such as a smaller ethylene/ethane splitter.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

For example, while the invention has been described above making specific reference to an embodiment wherein the amine treatment section 302 is placed downstream of the further compression section 290, those skilled in the art and guided by the teachings herein provided will appreciate that the broader practice of the invention is not necessarily so limited. Thus in certain embodiments it may be desired that the amine treatment section be disposed upstream of such further compression.

Also, while the invention has been described above making specific reference to an embodiment wherein the line 264, such as containing most of the $C_1$ and lighter gases removed through the stripper 262, is returned to the absorption zone 236 and the line 243, such as containing $C_3$+ hydrocarbons absorbed in or by the debutanized gasoline and main column liquid via the primary absorber 240, is returned to the stripper 262 those skilled in the art and guided by the teachings herein provided will appreciate that the broader practice of the invention is not necessarily so limited. For example, in accordance with an alternative embodiment either or both of such process stream or lines may preferentially be returned to the corresponding hydrocarbon separation system or, more specifically, to the staged compression section thereof for processing consistent therewith.

Furthermore, those skilled in the art and guided by the teachings herein provided will understand and appreciate that, if desired, selected processing operations can be appropriately rearranged and/or selected processing conditions altered such as to satisfy particular product or processing requirements. For example, in certain embodiments it may be desirable to recycle $C_4$+ hydrocarbons, such as recovered via the $C_3/C_4$ splitter that is downstream of the stripper, to the fluidized reactor zone such as to increase the yield of light olefins. In such an embodiment, the removal of possible contaminants, such as sulfide, mercaptan, diolefin and/or triolefin contaminants, for example, from such a $C_4$+ recycle stream may not be necessary because such materials will typically appropriately break down in the reactor zone. Thus to reduce processing loads on operations such as selective hydrogenation processing and mercaptan treatment, it may be desirable to relocate the $C_3/C_4$ splitter to precede such processing sections such that only the overhead stream from such a $C_3/C_4$ splitter undergoes such further processing.

What is claimed is:

1. A process for catalytically cracking a heavy hydrocarbon feedstock and obtaining selected hydrocarbon fractions, the process comprising:

contacting a heavy hydrocarbon feedstock with a hydrocarbon cracking catalyst in a fluidized reactor zone to produce a hydrocarbon effluent comprising a range of cracked hydrocarbon products including light olefins;

separating the hydrocarbon effluent in a separation section to form at least one separator liquid stream and a separator vapor stream, the at least one separator liquid stream comprising $C_3$+ hydrocarbons, the separator vapor stream comprising $C_3$− hydrocarbons;

contacting the separator vapor stream with a first absorption solvent in an absorption zone to remove $C_3$+ hydrocarbons therefrom and form a process stream comprising $C_2$− hydrocarbon materials;

bypassing the absorption zone with the at least one separator liquid stream;

stripping $C_1$− materials from the at least one separator liquid stream in a stripper section to form a $C_2$+ hydrocarbon process stream substantially free of $C_1$− materials;

separating $C_5$+ hydrocarbon materials from the $C_2$+ hydrocarbon process stream to form a first product process stream comprising $C_5$+ hydrocarbon materials and a second product process stream comprising $C_2$, $C_3$ and $C_4$ hydrocarbons; and introducing at least a first portion of the first product process stream to the absorption zone as a majority of the first absorption solvent.

2. The process of claim 1 additionally comprising splitting the second product process stream in a $C_3$-$C_4$ splitter section to form a first $C_3$-$C_4$ splitter process stream comprising primarily $C_2$ and $C_3$ hydrocarbons and a second $C_3$-$C_4$ splitter process stream comprising primarily $C_4$ hydrocarbons.

3. The process of claim 2 additionally comprising separating the first $C_3$-$C_4$ splitter process stream to form a $C_3$-$C_4$ splitter section vapor stream comprising primarily $C_2$− materials and a $C_3$-$C_4$ splitter section liquid stream comprising primarily $C_3$ hydrocarbons.

4. The process of claim 3 additionally comprising:

demethanizing at least a portion of the process stream comprising $C_2$− materials to form first and second demethanizer process streams, the first demethanizer process stream comprising primarily methane and hydrogen and the second demethanizer process stream comprising primarily $C_2$ hydrocarbons.

5. The process of claim 4 additionally comprising:

deethanizing at least a portion of a process stream selected from the group consisting of the second demethanizer process stream, the $C_3$-$C_4$ splitter section vapor stream, the $C_3$-$C_4$ splitter section liquid stream and combinations thereof in a deethanizer section to form a first deethanizer process stream comprising primarily $C_2$ hydrocarbons and a second deethanizer process stream comprising primarily $C_3$ hydrocarbons.

6. The process of claim 5 additionally comprising:

splitting the first deethanizer process stream in an ethylene/ethane splitter section to form a first ethylene/ethane splitter process stream comprising primarily ethylene and a second ethylene/ethane splitter process stream comprising primarily ethane.

7. The process of claim 5 additionally comprising:

splitting the second deethanizer process stream in a propylene/propane splitter section to form a first propylene/propane splitter process stream comprising primarily propylene and a second propylene/propane splitter process stream comprising primarily propane.

8. The process of claim 4 additionally comprising:

deethanizing at least a portion of each of the second demethanizer process stream, the $C_3$-$C_4$ splitter section vapor stream and the $C_3$-$C_4$ splitter section liquid stream in a deethanizer section to form a first deethanizer process stream comprising primarily $C_2$ hydrocarbons and a second deethanizer process stream comprising primarily $C_3$ hydrocarbons.

9. The process of claim 1 additionally comprising:

demethanizing at least a portion of the process stream comprising $C_2$− hydrocarbon materials to form first and second demethanizer process streams, the first demethanizer process stream comprising primarily methane and hydrogen and the second demethanizer process stream comprising primarily $C_2$ hydrocarbons.

10. The process of claim 9 additionally comprising:

deethanizing at least a portion of the second demethanizer process stream and at least a portion of the second product process stream in a deethanizer section to form a first deethanizer process stream comprising primarily $C_2$ hydrocarbons and a second deethanizer process stream comprising primarily $C_3$ hydrocarbons.

11. The process of claim 1 wherein said contacting of the heavy hydrocarbon feedstock with a hydrocarbon cracking catalyst comprises contacting the heavy hydrocarbon feedstock with a blended catalyst comprising regenerated catalyst and coked catalyst in a fluidized reactor zone at hydrocarbon cracking reaction conditions to produce a cracked stream containing hydrocarbon products including light olefins, said catalyst having a catalyst composition including a first component comprising a large pore molecular sieve and a second component comprising a zeolite with no greater than medium pore size, said zeolite with no greater than medium pore size comprising at least 1.0 wt. % of the catalyst composition.

12. The process of claim 1 additionally comprising splitting at least a second portion of the first product process stream in a divided wall separation column to form a light fraction comprising compounds containing five to six carbon atoms, an intermediate fraction comprising compounds containing seven to nine carbon atoms and a heavy fraction comprising compounds containing more than nine carbon atoms.

13. A process for catalytically cracking a heavy hydrocarbon feedstock and obtaining selected hydrocarbon fractions, the process comprising:

contacting a heavy hydrocarbon feedstock with a blended cracking catalyst comprising regenerated catalyst and coked catalyst in a fluidized reactor zone at hydrocarbon cracking reaction conditions to produce a hydrocarbon effluent stream comprising a range of hydrocarbon products including light olefins, said catalyst having a catalyst composition including a first component comprising a large pore molecular sieve and a second component comprising a zeolite with no greater than medium pore size, said zeolite with no greater than medium pore size comprising at least 1.0 wt. % of the catalyst composition;

separating the hydrocarbon effluent in a separation section to form at least one separator high pressure liquid stream and a separator high pressure vapor stream, the at least one separator high pressure liquid stream comprising $C_3$+ hydrocarbons, the separator high pressure vapor stream comprising $C_3$− hydrocarbons;

contacting the separator high pressure vapor stream with a first absorption solvent in a primary absorber to form a first primary absorber process stream comprising primarily $C_2$− hydrocarbons and residual amounts of $C_3$+ hydrocarbons;

contacting the first primary absorber process stream with a second absorption solvent to form a process stream comprising $C_2$− hydrocarbon materials and a process stream comprising residual $C_3$+ hydrocarbons and the second absorption solvent;

bypassing the absorption zone with the at least one separator high pressure liquid stream;

stripping $C_1$− materials from the separator high pressure liquid stream to form a $C_2$+ hydrocarbon process stream substantially free of $C_1$− materials;

separating $C_5$+ hydrocarbon materials from the $C_2$+ hydrocarbon process stream to form a first product process stream comprising $C_5$+ hydrocarbon materials and a second product process stream comprising $C_2$, $C_3$ and $C_4$ hydrocarbons; and introducing at least a first portion of the first product process stream to the primary absorber as a majority of the first absorption solvent.

14. The process of claim 13 additionally comprising:

demethanizing at least a portion of the process stream comprising $C_2$− hydrocarbon materials to form first and second demethanizer process streams, the first demethanizer process stream comprising primarily methane and hydrogen and the second demethanizer process stream comprising primarily $C_2$ hydrocarbons.

15. The process of claim 14 additionally comprising:

deethanizing at least a portion of the second demethanizer process stream and at least a portion of the second product process stream in a deethanizer section to form a first deethanizer process stream comprising primarily $C_2$ hydrocarbons and a second deethanizer process stream comprising primarily $C_3$ hydrocarbons.

16. The process of claim 13 additionally comprising splitting at least a second portion of the first product process stream in a divided wall separation column to form a light fraction comprising compounds containing five to six carbon atoms, an intermediate fraction comprising compounds containing seven to nine carbon atoms and a heavy fraction comprising compounds containing more than nine carbon atoms.

* * * * *